United States Patent [19]

Seidenberg

[11] Patent Number: 4,765,396

[45] Date of Patent: Aug. 23, 1988

[54] POLYMERIC HEAT PIPE WICK

[75] Inventor: Benjamin Seidenberg, Baltimore, Md.

[73] Assignee: The United States of America as represented by the Administrator of the National Aeronautics and Space Administration, Washington, D.C.

[21] Appl. No.: 942,158

[22] Filed: Dec. 16, 1986

[51] Int. Cl.[4] ..... F28D 15/02

[52] U.S. Cl. ..... 165/104.26; 138/38; 122/366; 165/905

[58] Field of Search ..... 165/104.26, 905; 122/366; 138/38, 40, 42

[56] References Cited

U.S. PATENT DOCUMENTS 3,840,069 10/1974 Fischer et al. .
3,901,311 8/1975 Kosson et al. ..... 165/104.26
3,954,927 5/1976 Duling et al. .
4,125,387 11/1978 Gunter .
4,165,614 8/1979 Yeh .
4,170,262 10/1979 Marcus et al. .
4,274,479 6/1981 Eastman .
4,280,333 7/1981 Corliss et al. .
4,414,961 11/1983 Luebbe ..... 165/104.26
4,523,636 6/1985 Meijer et al. .

FOREIGN PATENT DOCUMENTS 482711 4/1938 United Kingdom .

*Primary Examiner*—Albert W. Davis, Jr.
*Attorney, Agent, or Firm*—R. Dennis Marchant; John R. Manning; Ronald F. Sandler

[57] ABSTRACT

A wick for use in a capillary loop pump heat pipe. The wick material is an essentially uniformly porous, permeable, open-cell, polyethylene thermoplastic foam having an ultra high average molecular weight of from approximately 1,000,000 to 5,000,000, and an average pore size of about 10 to 12 microns. A representative material having these characteristics is POREX UF which has an average molecular weight of about 3,000,000. This material is fully compatible with the FREONs and anhydrous ammonia and allows for the use of these very efficient working fluids in capillary loops.

17 Claims, 1 Drawing Sheet

POLYMERIC HEAT PIPE WICK

ORIGIN OF THE INVENTION

The invention described herein was made by an employee of the U.S. Government and may be manufactured and used by or for the government of the United States of America for governmental purposes without the payment of any royalties thereon or therefor.

TECHNICAL FIELD

This invention generally relates to the art of heat exchange, and more particularly to a wick suitable for use within a capillary pump loop heat pipe system.

BACKGROUND ART

There are situations in which heat must be transferred from a locale of heat generation to a locale of heat rejection under circumstances in which insufficient energy exists to operate a conventional heat transfer system. This occurs in spacecraft environments where large amounts of heat must be rejected to ensure the proper operation of the spacecraft and its systems. Locales of heat generation in a spacecraft include the onboard electronics and exterior surfaces facing the sun, while locales of heat rejection include exterior surfaces not facing the sun and areas requiring heat, such as a crew's cabin.

One system which transfers heat efficiently with little or no external power requirements is the capillary pump loop (CPL) heat pipe system. A CPL heat pipe system is a two-phase heat transfer system which utilizes a vaporizable liquid. Ammonia and the FREONs have been found to be suitable working liquids. Heat is absorbed by the liquid when its phase changes from a liquid state to a vapor state upon evaporation, and heat is released when condensation of the vapor occurs. The CPL heat pipe system includes a heat pipe containing a capillary structure, such as a porous wick, and a continuous loop. The continuous loop provides a vapor phase flow zone, a condenser zone, and a liquid return zone.

The key factor affecting the efficiency of the heat transfer by a CPL heat pipe system is the selection of the working fluid. In turn, the wick employed in the loop must be compatible with the working fluid. Besides being compatible with the working fluid, good wicks must have uniform porosity, small pore size and high molecular weight. Compatibility must be both chemical and physical. The wick must not swell, shrink or shed particles. Uniform porosity is required to achieve uniform flow and a uniform pressure head at the outside surface of the wick. The pore size of the wick should be very small, because as the pore size decreases, the capillary pressure, i.e., fluid static height or pumping action which the wick can generate, increases, and the amount of heat which can be transferred also increases. However, as the pore size decreases, the permeability of the wick to radial and longitudinal fluid flow also decreases. Also, the tendency for the wick to clog may increase. Thus, for maximum heat transfer efficiency, a wick material offering both small pore size and high permeability is preferable. Other factors are also to be considered in selecting a wick material. The wick material should be resistant to chemical attack by the working fluid, and it should not contaminate the fluid chemically or physically generate particulates. Chemical contamination of the fluid will change its evaporation characteristics, and it may produce gas bubbles which will accumulate and enlarge in the condenser zone and eventually block it. Particulate contamination will also cause blockage of the continuous loop. Furthermore, it is desirable for the wick material to be resistant to degradation by heat, and to be cold resistant for use in low temperatures heat transfer applications. Generally, it is desirable for the wick to operate from −70° C. to +70° C. Lastly, the wick material should be easy to machine so that it can be made to conform to a heat pipe having any geometrical shape, and flexible so as to be vibration resistant.

Heat pipe wicks have been heretofore fabricated of various types of materials in an attempt to achieve ammonia and FREON compatible wicks. One type of material is a brillo-like metal wire mesh, but no capillary action was achieved. Examples of metals used are copper, stainless steel, and aluminum. Wire mesh wicks are made by knitting, felting round wire, and by stacking corrugated flat ribbon wire. They generally have pores of nonuniform size, which results in the poor and uneven generation of capillary pressure along the length of the wick, and they are subject to chemical attack by corrosive fluids. They are also very friable, which results in the fluid being contaminated with particulates, and they can chemically contaminate the fluid.

Another type of wick material is a sintered metal wick. Examples of metals used in sintered metal wicks are copper, oxidized stainless steel, molybdenum, tungsten, and nickel. These wicks are generally constructed in tubular or flat sheet form by heating metal powder or metal slurries on a removable, cylindrical or flat mold mandrel. Wicks produced by this method are usually friable, and have pores of uneven size. They are also subject to chemical attack by corrosive fluids, and they can chemically react with chemically active fluids to contaminate them.

Heat pipe wicks may also be constructed of sintered ceramics. Sintered ceramic wicks, however, are extremely friable, and they exhibit poor capillary performance. Additionally, they are physically and chemically degraded in use, and they are difficult to produce in tubular form.

Two other types of wick materials are cloth wicks and glass fiber wicks. Cloth wicks are generally formed by stacking disks of cloth cut out of a sheet to form a cylinder. Cloth wicks are subject to attack by corrosive fluids, and they produce particulates and fibers in use. Glass fibers, on the other hand, are not subject to attack by corrosive fluids. However, they are very brittle, hard to form into a desired shape, and they cannot be greatly stressed or strained in use without breaking.

One particular material which has been used as a heat pipe wick is a felted ceramic comprised of 50% $SiO_2$ and 50% $Al_2O_3$. Rings of this material are cut out of a sheet and stacked together to form a cylinder. This material is extremely friable, and it exhibits poor capillary performance. It also produces particulates during use and is subject to chemical attack by corrosive fluids.

Of all the known CPL wicks, including those noted above, none have been found to be suitable for use with anhydrous ammonia and the FREONS, such as FREON 11, which are the most effective refrigerants known.

STATEMENT OF INVENTION

Accordingly, it is an object of this invention to provide a wick which is generally suitable for use in CPL heat pipe exchange systems.

Another object of this invention is to provide a wick which is resistant to heat and cold.

A further object of this invention is to provide a wick which will not produce either chemical or particulate contaminents during use.

Still a further object of this invention is to provide a wick which is not degraded in use.

Still another object of this invention is to provide a wick suitable for use in CPL heat pipe systems employing anhydrous ammonia or FREONs as the working fluid.

Yet another object of this invention is to provide a wick constructed from material which is easily machined.

A still further object of this invention is to provide a CPL heat pipe system employing anhydrous ammonia or a fluorinated hydrocarbon working fluid with a wick that is physically and chemically compatible therewith.

According to the invention, the foregoing and other objects are attained by providing a wick comprised of a uniformly porous, small pore-size, permeable, very high molecular weight, polymer which is compatible with ammonia and the FREONS in the form of an open-cell, polyethylene, thermoplastic foam.

DETAILED DESCRIPTION

Figure 1:
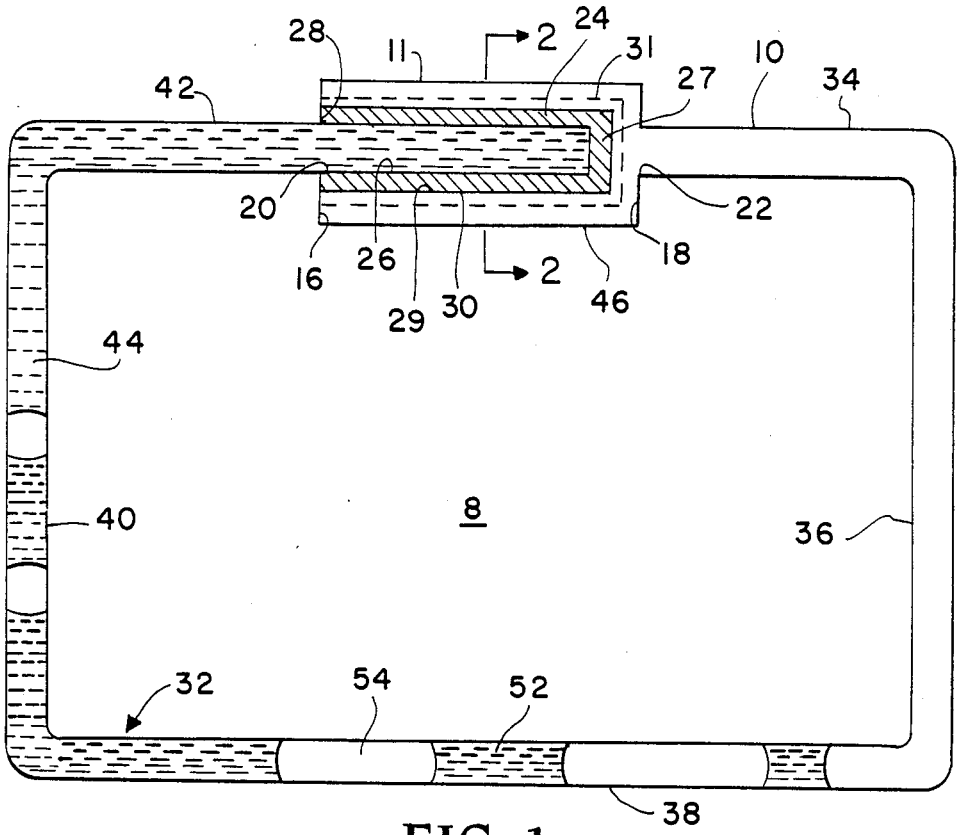
FIG. 1 is a full cut-away view of a capillary pump loop system taken through a plane which includes the central longitudinal axis of the heat pipe and the central longitudinal axis of each section of the continuous loop, and, FIG. 2 is a section of the heat pipe taken along line 2—2 of FIG. 1.
Figure 2:
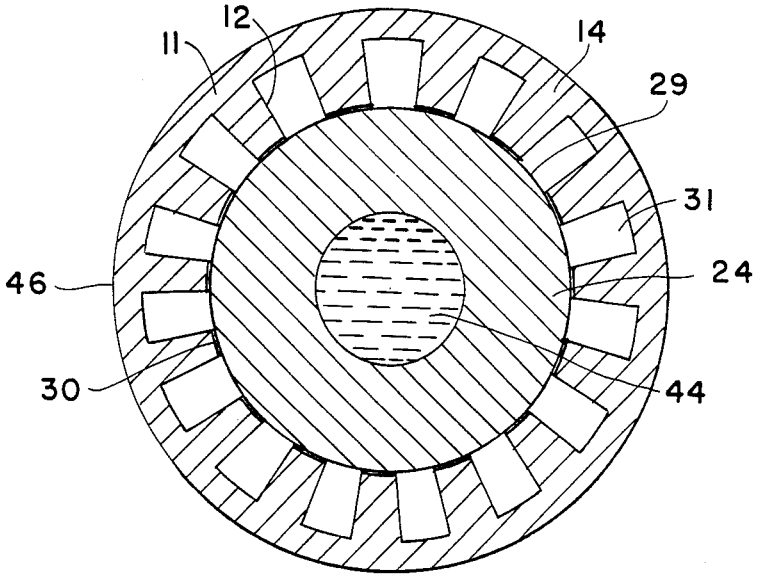

Referring now to the drawings wherein like reference numerals and characters designate identical or corresponding parts throughout the several views, and more particularly to FIG. 1 wherein a capillary pump loop heat pipe system 8 is illustrated. The capillary pump loop heat pipe system 8 includes a heat pipe 10 which extends around the entire loop, has a central longitudinal axis, not illustrated, and is preferably cylindrical in shape. As shown in FIG. 2, the portion of the heat pipe, 11, which is designed to contain a wick, preferably has axial grooves 12 in its inner surface which form a series of continuous fins 14. The grooves and fins extend along the entire length of heat pipe portion 11. Their purposes will be hereinafter explained. Heat pipe portion 11 is bounded at its ends by walls 16 and 18 which may be either an integral part of the pipe or secured thereto in a conventional way. Wall 16 has a round, centrally located port 20 for liquid entry, and wall 18 has a round, centrally located port 22 for vapor outlet. Both ports have the same diameter. Heat pipe portion 11, and walls 16 and 18, may be constructed from any suitable material, such as aluminum or stainless steel.

Heat pipe portion 11 is centrally packed with a porous, elongated wick 24. Wick 24 has a central longitudinal axis, not illustrated, which is coextensive with the central longitudinal axis of heat pipe portion 11, and a central bore 26 extending partially along the axis from an open end 28 of the wick. Although flat wicks can be used, in this embodiment wick 24 and bore 26 are in the preferred cylindrical shape, and the diameter of bore 26 is preferably equal to the diameter of port 20. The wick has a closed end 27. Wick 24 preferably occupies almost the entire volume of heat pipe portion 11 and is placed within the heat pipe portion so that its end 28 abuts wall 16 and its outer surface 29 contacts the inner surface 30 of the heat pipe portion. The volume not occupied by wick 24 and bore 26, which includes the volume enclosed by the series of hollow fins 14, forms a channel 31 within the heat pipe surrounding the wick. A channel 31 which vents into port 22 is provided for vapor flow. It should be noted that the heat pipe portion may be fabricated with a smooth inner surface and the axial grooves cut into the outside surface of the wick. It is only important that there exist some type of channel for venting the vapor.

A continuous loop of metallic tubing 32 is connected between ports 20 and 22. Loop 32 includes a segment 34 and another segment 36 which together form the vapor phase flow zone of system 8. The tubing also has a segment 38 which forms the condenser zone, and segments 40 and 42 which together form the liquid return zone of system 8. The tubing comprising loop 32 preferably is cylindrical and has an outside diameter which is equal to the diameter of ports 20 and 22. The tubing may be made of any suitable material, such as aluminum or stainless steel, and is preferably smooth walled. It should be noted that the metals which are employed must be compatible with working fluids which are used.

A vaporizable fluid 44 in its liquid phase is initially present in the condenser and liquid return zones of system 8 and in bore 26. The liquid phase of fluid 44 also saturates wick 24. Examples of fluids which may be used include anhydrous ammonia ($NH_3$), and FREONS which include trichlorofluoromethane $CCl_3F$, trichlorotrifluoroethane $CCl_2FCClF_2$, and dichlorotetrafluoroethane $CClF_2CClF_2$. Channel 31 contains the vapor phase of the fluid 44, which results from evaporation of the fluid from wick 24, at a vapor pressure corresponding to the saturation pressure of the fluid at the instantaneous temperature of heat pipe 10. Free flow of the liquid is blocked by closed end 27 of the wick.

Heat to be removed from a source of heat, not illustrated, such as spacecraft electronics, is directly applied to heat pipe portion 11 by placing the heat pipe portion adjacent to or in close proximity with the heat source. The exterior surface 46 of heat pipe portion 11 will absorb the heat, which, in turn, will be transferred to the interior of the heat pipe, thereby resulting in a temperature rise which will increase the vapor pressure of the vapor phase of fluid 44 and cause evaporation of the liquid. Grooves 12 and fins 14 aid in this process by providing a very large surface area which can absorb heat. Evaporation of the liquid will mostly occur at the inside surface 30, illustrated in FIG. 2, of heat pipe portion 11 which is closest to wick 24 because this surface provides the most direct heat transfer. Vapor bubbles, not illustrated, will form on the outer surface 29 of wick 24 closest to surface 30, and they will migrate until vented into channel 31.

Capillary action in wick 24 provides the necessary pressure differential to initiate vapor flow from channel 31 into the vapor phase flow zone and, in turn, into the condenser zone. Capillary action in wick 24 also causes the liquid to be continually supplied to surface 29 of wick 24. The surface tension of the liquid at outer surface 29 prevents migration of the vapor bubbles into the wick structure. This, in turn, prevents the capillary action of wick 24 from being blocked, which may occur if a sufficient number of vapor bubbles enters the wick. It also helps to ensure that flow around the capillary pump loop heat pipe system 8 is unidirectional from port 22 to port 20.

The condenser zone of system 8 is at a lower temperature than that of the vapor phase flow zone, and this causes the vapor flow to begin to condense. Heat will be removed from the vapor as it condenses in the condenser zone. In a spacecraft, the condenser segment 38 may be placed in an area away from sources of heat or in an area which requires a heat source, such as a crew compartment. Flow in the condenser segment 38 initially consists of high-velocity vapor plus a liquid wall film which subsequently turns, as the vapor cools, into slugs of liquid 52 separated by bubbles of vapor 54. The slight pressure exerted by the flow of the vapor from the vapor phase flow zone, comprising segments 34 and 36, causes both the vapor and the condensate to flow back toward heat pipe 10 through the liquid return zone, comprising segments 40 and 42. The liquid return zone is subcooled to collapse any remaining vapor bubbles. In a spacecraft, this may be accomplished by placing segments 40 and 42 in an unheated area of the spacecraft which is not exposed to radiation from the sun.

The wick 24 preferably will have uniform porosity, very small, interconnecting pores so that the wick can generate a large capillary pressure, high permeability to liquid flow, resistance to degradation by high and low temperatures, and resistance to degradation by chemicals, including swelling. The wick material should not chemically contaminate the fluid used in the capillary loop pump heat pipe system, and it should also not produce particulates. Lastly, it should be easy to machine so that it can be made to conform to a heat pipe having any shape. A material which has all of these physical and chemical characteristics is an ultra high molecular weight polyethylene, open-cell, thermoplastic foam, having the chemical composition $[CH_2CH_2]_n$, and an average molecular weight of about 3,000,000. It is anticipated that this type of material can be manufactured as an effective wick material with an average molecular weight of up to 5,000,000. Above 3,000,000, however, the material will be somewhat harder to form because it will be very hard. With average molecular weights below 1,000,000, swelling may be a problem because of the possible chemical reaction with the working fluids employed. This type of foam, with an average molecular weight of about 3,000,000, is sold as POREX UF under the trademark "POREX", which is owned by Porex Technologies, Inc., of Fairburn, Ga. POREX UF has been previously used as a conventional filter material, but not as a wick.

The void volume density of POREX UF ranges between 40% and 55%, and its density at a 40% void volume is 0.58 g/cc. Its average pore size is 10 to 12 microns, and it is highly permeable. A one inch diameter tube of POREX UF having a ¼ inch wall thickness will draw up to 19 inches of a liquid, such as water or an alcolol, e.g., methanol, in a static height test utilizing a manometer at one atmosphere. The specific gravity of POREX UF, unfoamed, is 0.94, and its coefficient of thermal expansion is $13\times10^{-5}$ in/in/°C. The ultra high molecular weight of this material makes it resistant to degration by heat. It can withstand a continuously maximum temperature of 82° C., or up to 116° C. intermittently. It is also resistant to degradation by cold temperatures down to −70° C. Very importantly, its very high molecular weight makes it resistant to and compatible with concentrated alkalis such as anhydrous ammonia, $NH_3$, and to many organic solvents below 80° C., but it is not resistant to strong oxidizing acids. Also very importantly, this material is compatible with FREONs such as trichlorofluoromethane, $CCl_3F$, trichlorotrifluoroethane, $CCl_2FCClF_2$, and with dichlorotetrafluoroethane $CClF_2CClF_2$. Other known CPL wicks have not been compatible with these working fluids, which constitute what may be the best of all the refrigerants. This wick material is also compatible with other known refrigerants such as, but not limited to, water, water-salts, alcohols and oil derived from citrus. POREX UF is flexible and not fragile in any way, which makes it suitable for use in high vibration environments, and it possesses a self-lubricating surface which makes it easy to machine and to insert into heat pipes. Its ultra high molecular weight contributes greatly to its machinability.

Obviously, numerous modifications and variations of the present invention are possible in the light of this disclosure. It is therefore to be understood that within the scope of the appended claims the invention may be practiced otherwise than as specifically described therein.

I claim:

1. A wick for inclusion in a capillary loop including a first surface means for contacting a working fluid in a liquid state in said loop, said working fluid being selected from the group consisting of anhydrous ammonia and the fluorinated hydrocarbons, and a second surface means for evaporation of said liquid in said loop, said wick being comprised of a polymer which is essentially uniformly porous and permeable and which has an average molecular weight in the range of about one million to five million with a small average pore size, said polymer being chemically and physically compatible with said working fluid.

2. The wick of claim 1 wherein said wick generally has a shape of a hollowed cylinder with an open end for liquid entrance and a closed end to block liquid flow, said first surface means being the interior surface area of said cylinder and said second surface means being the exterior surface area of said cylinder.

3. The wick of claim 1 wherein said polymer is an open-cell, polyethylene, thermoplastic foam.

4. The wick of claim 1 wherein said average molecular weight is approximately 3,000,000.

5. The wick of claim 3 wherein said small average pore size is in the range of about 10 to 12 microns.

6. The wick of claim 3 wherein said polymer has an average molecular weight of 3,000,000, an average pore size of about 10 to 12 microns, a void volume density of from 40 to 55%, a density at 40% void volume of 0.58 g/cc, a specific gravity unfoamed of 0.94, and a coefficient of thermal expansion of $13\times10^{-5}$ in/in/°C.

7. A capillary loop including a heat pipe in the form of a continuous loop, a wick positioned within less than the entire portion of said heat pipe comprised of an essentially uniformly porous, permeable and ultra high average molecular weight polymer with a small average pore size, said loop further including a working fluid contained within said heat pipe, said working fluid being selected from the group consisting of anhydrous ammonia and the fluorinated hydrocarbons, said polymer being chemically and physically compatible with said working fluid.

8. The capillary loop of claim 7 wherein said polymer is an open-cell, polyethylene, thermoplastic foam with an average molecular weight in the range of from approximately 1,000,000 to 5,000,000 and an average pore size of about 10 to 12 microns.

9. The capillary loop of claim 7 wherein said average molecular weight is approximately 3,000,000.

10. The capillary loop of claim 7 wherein said fluorinated hydrocarbon is trichlorofluoromethane.

11. The capillary loop of claim 7 wherein said fluorinated hydrocarbon is trichlorotrifluoroethane.

12. The capillary loop of claim 7 wherein said fluorinated hydrocarbon is dichlorotetrafluoroethane.

13. The capillary loop of claim 7 wherein said portion of said heat pipe in which said wick is positioned has a plurality of spaced axial grooves formed therein contiguously surrounding said wick.

14. A wick for inclusion in a capillary loop including a first surface means for contacting a working fluid in a liquid state in said loop and a second surface means for evaporation of said liquid in said loop, said wick being comprised of a porous, permeable and ultra high average molecular weight, open-cell, polyethylene foam.

15. The wick of claim 14 wherein said ultra high average molecular weight is in the range of from approximately 1,000,000 to 5,000,000.

16. The wick of claim 14 wherein said ultra high average molecular weight is approximately 3,000,000.

17. The wick of claim 14 wherein said foam has a small average pore size in the range of about 10 to 12 microns.

* * * * *